US009647342B2

(12) United States Patent
Wright

(10) Patent No.: US 9,647,342 B2
(45) Date of Patent: May 9, 2017

(54) MODULAR FEED ASSEMBLY

(71) Applicant: CommScope Technologies LLC, Hickory, NC (US)

(72) Inventor: Alastair D. Wright, Edinburgh (GB)

(73) Assignee: CommScope Technologies LLC, Hickory, NC (US)

( * ) Notice: Subject to any disclaimer, the term of this patent is extended or adjusted under 35 U.S.C. 154(b) by 32 days.

(21) Appl. No.: 14/648,729

(22) PCT Filed: Aug. 22, 2014

(86) PCT No.: PCT/US2014/052215
§ 371 (c)(1),
(2) Date: Jun. 1, 2015

(87) PCT Pub. No.: WO2015/076885
PCT Pub. Date: May 28, 2015

(65) Prior Publication Data

US 2015/0303580 A1 Oct. 22, 2015

Related U.S. Application Data

(60) Provisional application No. 61/905,933, filed on Nov. 19, 2013, provisional application No. 62/013,098, filed on Jun. 17, 2014.

(51) Int. Cl.
*H01Q 15/00* (2006.01)
*H01Q 13/02* (2006.01)
(Continued)

(52) U.S. Cl.
CPC ..... *H01Q 13/02* (2013.01); *H01P 1/042* (2013.01); *H01Q 1/00* (2013.01); *H01Q 13/0283* (2013.01); *H01P 1/161* (2013.01)

(58) Field of Classification Search
CPC ..... H01Q 13/02; H01Q 13/0283; H01Q 1/00; H01P 1/042; H01P 1/161
(Continued)

(56) References Cited

U.S. PATENT DOCUMENTS 2,429,640 A 10/1947 Mieher et al.
4,623,858 A 11/1986 Montesanto et al.
(Continued)

FOREIGN PATENT DOCUMENTS

EP 0817307 A2 1/1998
EP 1933412 A2 6/2008

OTHER PUBLICATIONS

International Search Report and Written Opinion; Mailed Nov. 10, 2014 for the corresponding PCT/US2014/052215.

*Primary Examiner* — Brian Young
(74) *Attorney, Agent, or Firm* — Myers Bigel, P.A.

(57) ABSTRACT

In one embodiment, a modular feed assembly for an antenna has (i) a hub adapter for mounting the feed assembly onto the antenna hub and (ii) a distinct waveguide transition configured to be selectively mated to the hub adapter. By providing a modular design, the hub adapter can be selectively used with different waveguide transitions having different frequency characteristics to form feed assemblies for different antennas having different operating frequency ranges. The hub adapter and each waveguide transition have timing features that limit the rotation orientation between the two components to, for example, horizontal and vertical polarizations that are 90 degrees apart. The hub adapter has a resilient compression element that forms an annular seal between the hub adapter and a mated waveguide transition to inhibit RF leakage and keep the two components in place. The hub adapter has openings that allow the compression element to be formed in place.

18 Claims, 20 Drawing Sheets

(51) Int. Cl.

| | |
|---|---|
| ***H01P 1/04*** | (2006.01) |
| ***H01Q 1/00*** | (2006.01) |
| *H01P 1/161* | (2006.01) |

(58) Field of Classification Search
USPC ..... 343/771, 772, 776
See application file for complete search history.

(56) References Cited

U.S. PATENT DOCUMENTS

| | | | | |
|---|---|---|---|---|
| 5,714,963 | A | 2/1998 | Cox | |
| 6,542,662 | B2 * | 4/2003 | Cheung | H01Q 3/46 385/147 |
| 6,661,305 | B1 * | 12/2003 | Rosenberg | H01P 5/082 333/21 R |
| 7,068,121 | B2 * | 6/2006 | Ding | H01P 5/107 333/21 R |
| 7,132,910 | B2 * | 11/2006 | Graczyk | H01P 1/042 333/254 |
| 7,352,258 | B2 * | 4/2008 | Andrews | H01P 5/103 333/245 |
| 9,105,952 | B2 * | 8/2015 | Hoover | H01P 5/082 |
| 2004/0263291 | A1 | 12/2004 | Corkill et al. | |

* cited by examiner

MODULAR FEED ASSEMBLY

CROSS-REFERENCE TO RELATED APPLICATIONS

This application claims the benefit of the filing dates of U.S. provisional application Nos. 61/905,933, filed on Nov. 19, 2013, and 62/013,098, filed on Jun. 17, 2014, the teachings of which are incorporated herein by reference in their entirety.

BACKGROUND

Field of the Invention

The present invention relates to antennas and, more specifically but not exclusively, to feed assemblies for reflector antennas.

Description of the Related Art

This section introduces aspects that may help facilitate a better understanding of the invention. Accordingly, the statements of this section are to be read in this light and are not to be understood as admissions about what is prior art or what is not prior art.

Reflector antennas may utilize a feed assembly wherein a sub-reflector is supported proximate the focal point of the reflector dish by a waveguide and dielectric cone. The feed assembly may be coupled to a hub of the reflector antenna by fasteners.

The orientation of the feed assembly may be rotated to select a desired signal polarization, typically in 90-degree increments.

If sealing between the feed assembly and the hub is inadequate, RF leakage between the feed assembly and hub may generate backlobes in the antenna signal pattern, degrading electrical performance of the antenna.

Feed assemblies are typically designed and manufactured in several different operating-frequency-specific embodiments, requiring significant engineering, procurement, materials, manufacturing, and inventory expense.

BRIEF DESCRIPTION OF THE DRAWINGS

Other embodiments of the invention will become more fully apparent from the following detailed description, the appended claims, and the accompanying drawings in which like reference numerals identify similar or identical elements.

DETAILED DESCRIPTION

A significant cost efficiency may be realized by isolating portions of a feed assembly that are frequency specific, to reduce the number of unique elements required to manufacture a family of feed assemblies for a wide range of operating frequencies. Further, by reducing the size of such frequency-specific components, cost-efficient polymer materials and component configurations suitable for fabrication via injection molding may be applied to a greater portion of the assembly, further reducing material and fabrication costs. Polymer materials also enable simplified insertion-connect-type attachment/alignment and/or integral-seal arrangements with improved assembly and/or sealing characteristics.

Figure 3:
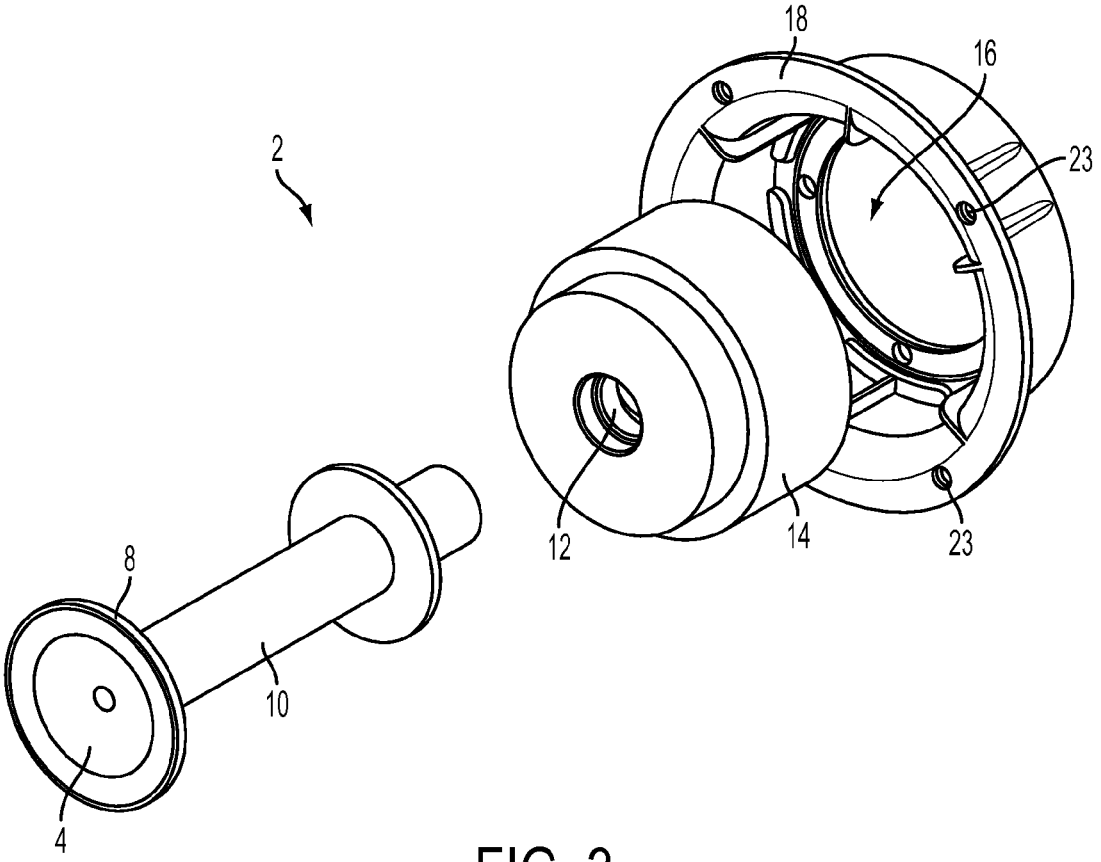
FIG. 3 is a schematic isometric exploded view of the modular feed assembly of FIG. 1.
Figure 4:
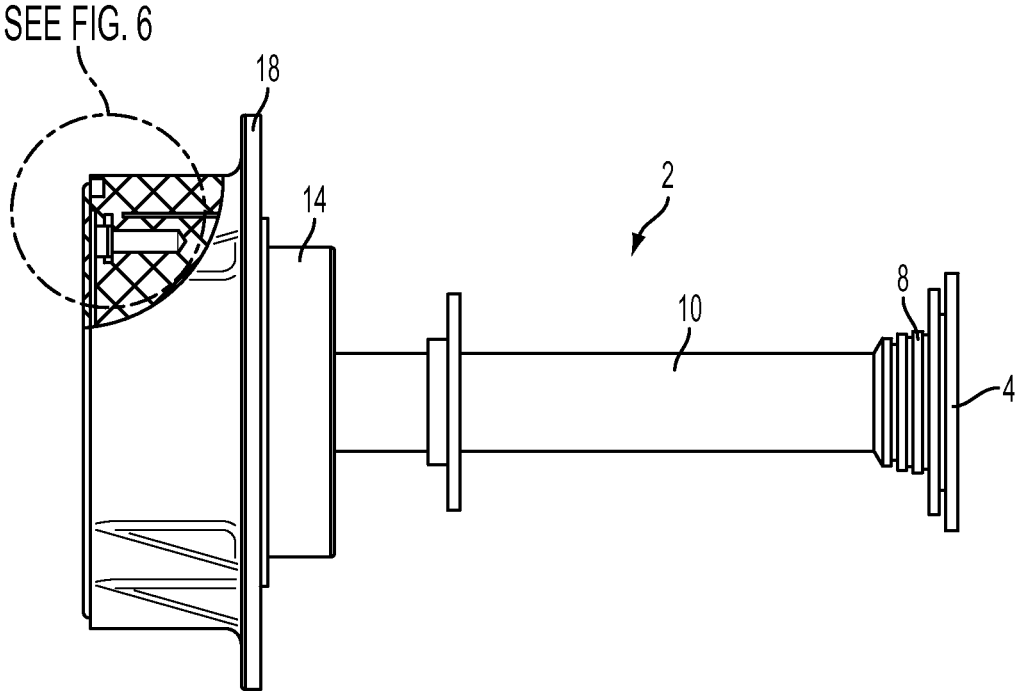
FIG. 4 is a schematic side view with partial cut-away of the assembled modular feed assembly of FIG. 1.

As shown in FIGS. 1-9, an exemplary embodiment of a modular feed assembly 2 supports a sub-reflector 4 proximate a focal point of a reflector dish 6. As best shown in FIGS. 3-4, the subreflector 4 is coupled to a dielectric block 8 provided at a distal end of a waveguide 10. The proximal end of the waveguide 10 seats within the RF bore 12 of a transition 14. The transition 14 seats within the transition bore 16 of a hub adapter 18. The hub adapter 18 is dimensioned to secure the modular feed assembly 2 with respect to a hub 20 (FIGS. 1-2) of the reflector dish 6 via fasteners applied through holes 23.

Figure 5:
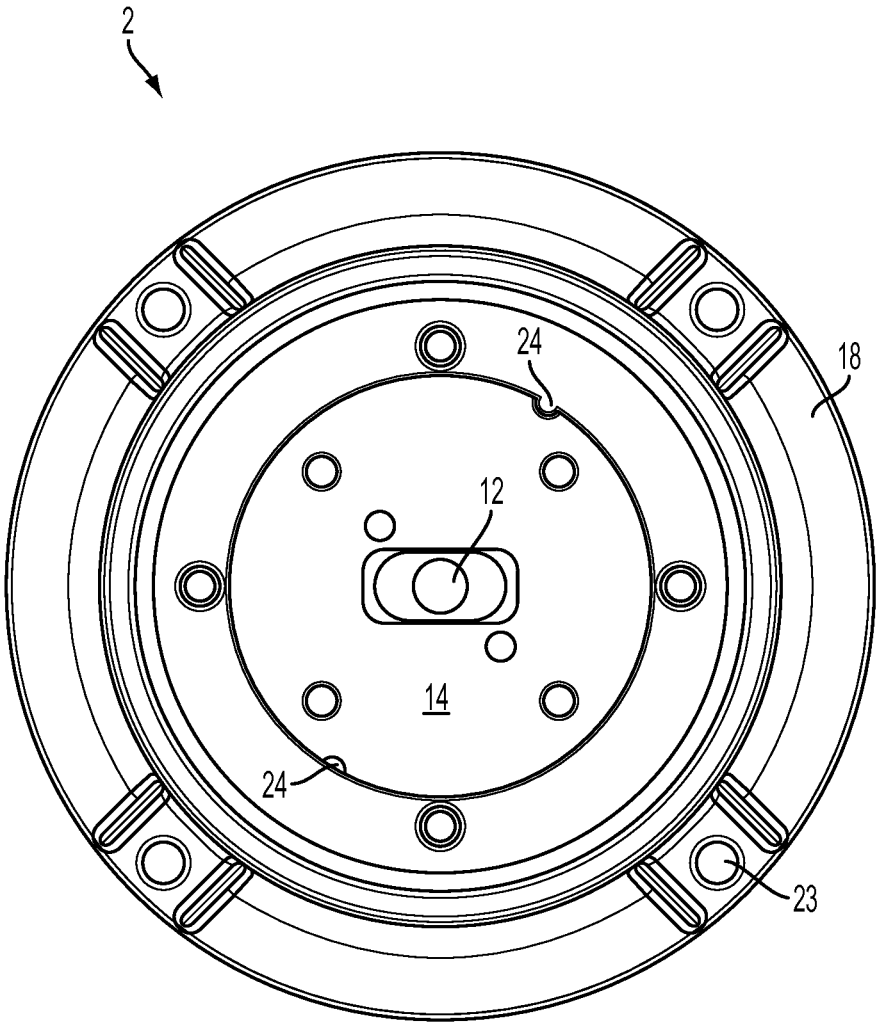
FIG. 5 is a schematic proximal end view of the modular feed assembly of FIG. 4.
Figure 6:
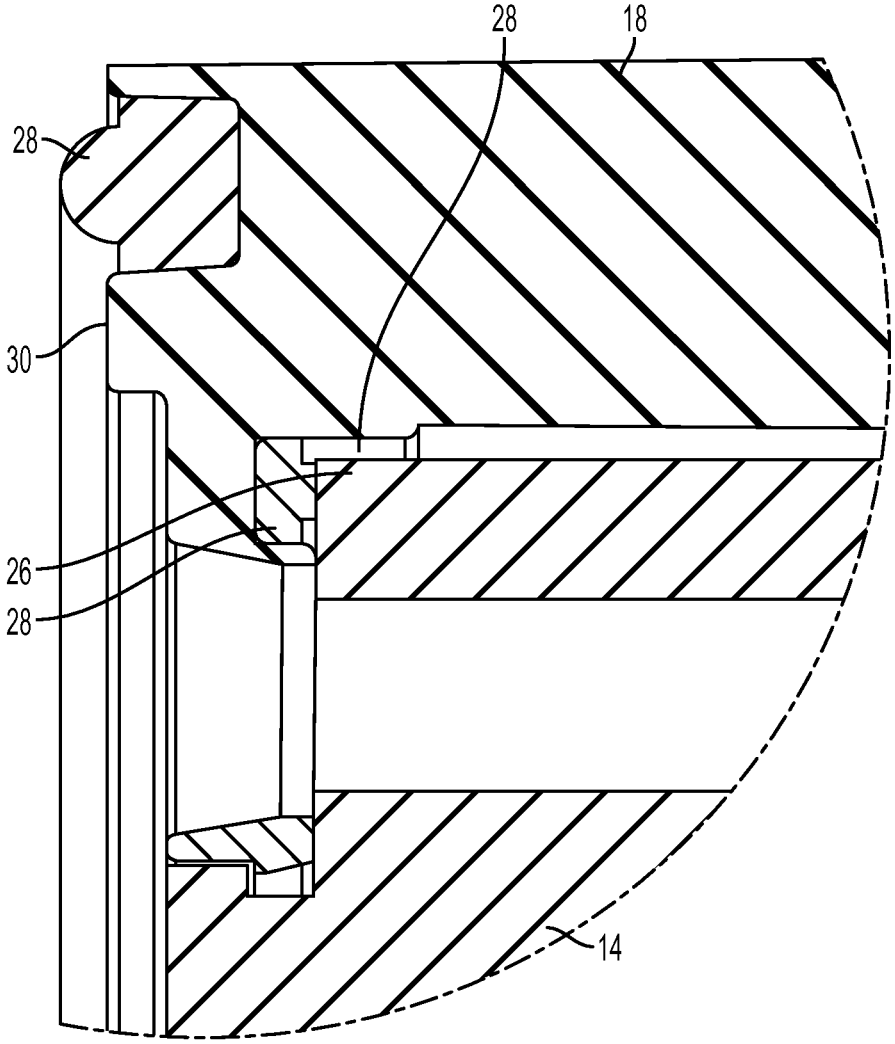
FIG. 6 is a close-up view of area A of FIG. 4.
Figure 9:
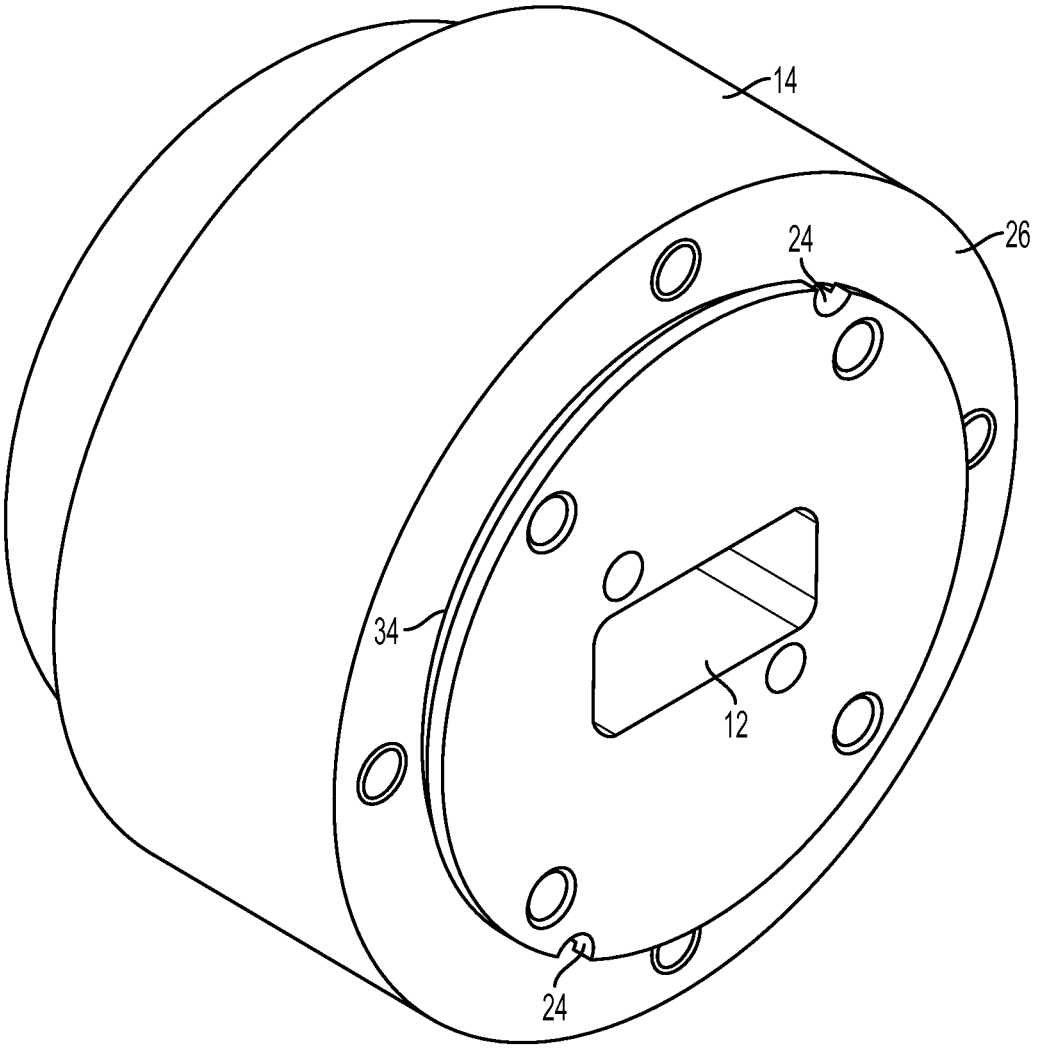
FIG. 9 is a schematic angled isometric distal end view of the transition of the modular feed assembly of FIG. 4.

The RF bore 12 of the transition 14 provides frequency-specific impedance matching to efficiently launch/receive RF signals into/from the waveguide 10 and to/from downstream equipment coupled to the transition 14, such as transceivers or the like. The RF bore 12 may include, for example, a waveguide transition from a circular waveguide (FIG. 3) to a rectangular waveguide (FIGS. 5 and 9). The precision features of the RF bore 12 may be formed, for example, by machining and/or casting the transition 14 from metal material. To minimize the amount of metal material required for the transition 14, the hub adapter 18 is applied to provide structure for supporting the transition 14 and thereby the sub-reflector 4 with respect to the reflector dish 6 and any downstream equipment.

Figure 7:
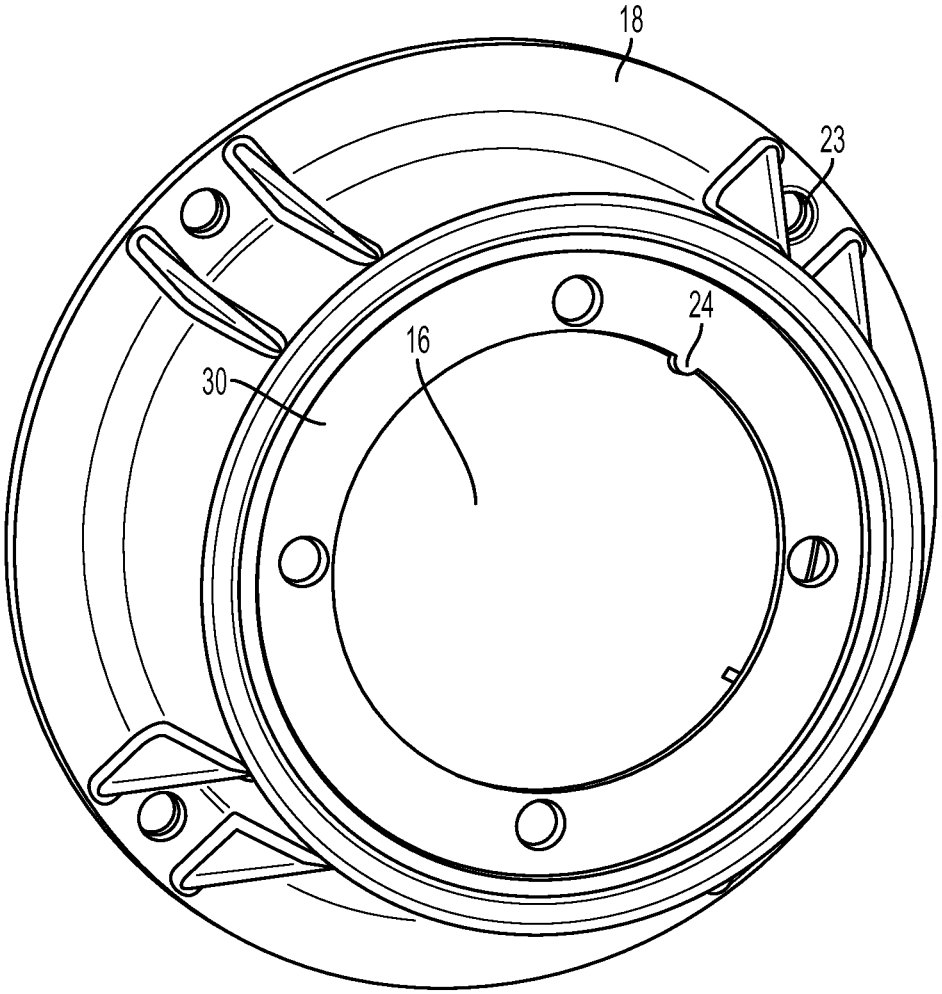
FIG. 7 is a schematic isometric proximal end view of the hub adapter of the modular feed assembly of FIG. 4.
Figure 8:
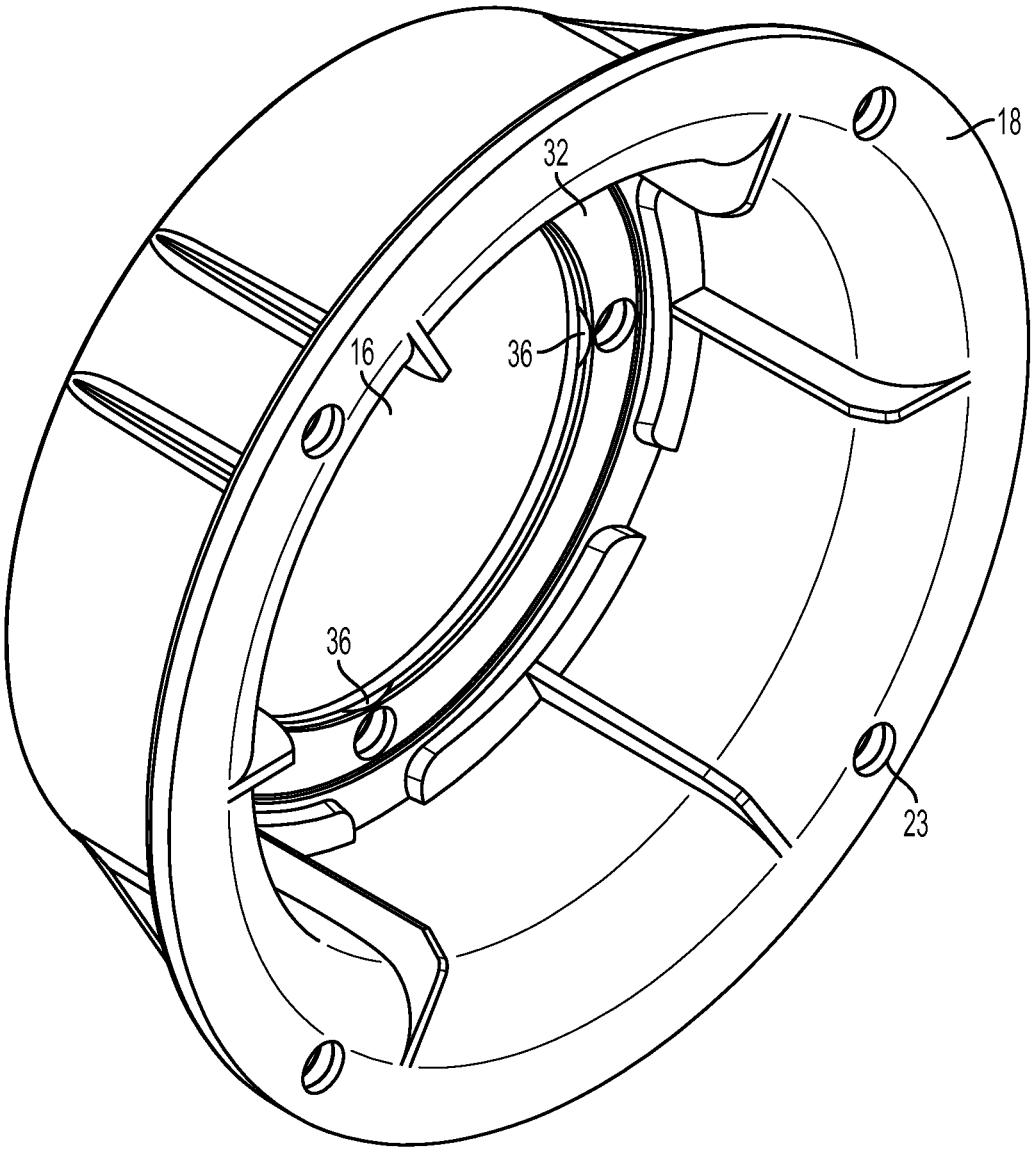
FIG. 8 is a schematic angled isometric distal end view of the hub adapter of the modular feed assembly of FIG. 4.

As best shown in FIGS. 3, 7, and 8, the transition 14 seats within a transition bore 16 of the hub adapter 18. A timing feature 24 (FIGS. 5 and 7) on the proximal end of the transition 14, such as a tab or slot may key with a corresponding tab or slot of the hub adapter 18 to key a rotation angle of the transition 14 with respect to the hub adapter 18. Providing multiple timing features 24, for example, spaced apart by 90 degrees, enables selection of an initial polarization alignment of the modular feed assembly 2 with respect to the hub adapter 18, which may itself be rotated with respect to the hub 20 for polarity selection. In the three alternative embodiments of FIGS. 10, 11-12, and 13-15, a non-circular cross-section of the transition 14*a,b,c* between a seat shoulder 26*a,b,c* of the transition 14*a,b,c* and a proximal end of the transition 14*a,b,c* may also provide timing-feature functionality. The seat shoulder 26 (FIGS. 6 and 9) also enables the proximal end of the transition 14 to extend through the hub adapter 18 for ease of coupling with downstream equipment.

Figure 10:
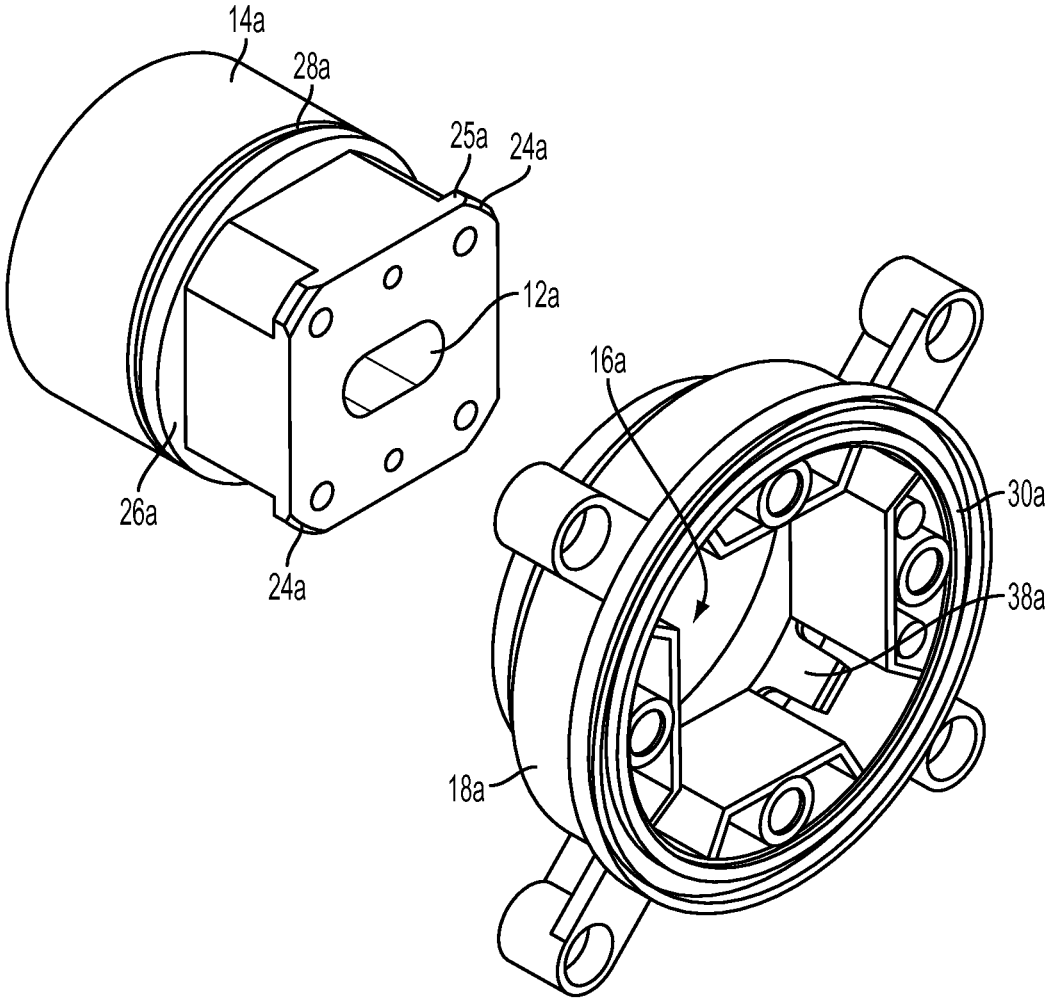
FIG. 10 is a schematic angled isometric distal end view of an alternative transition and hub adapter for a modular feed assembly.
Figure 11:
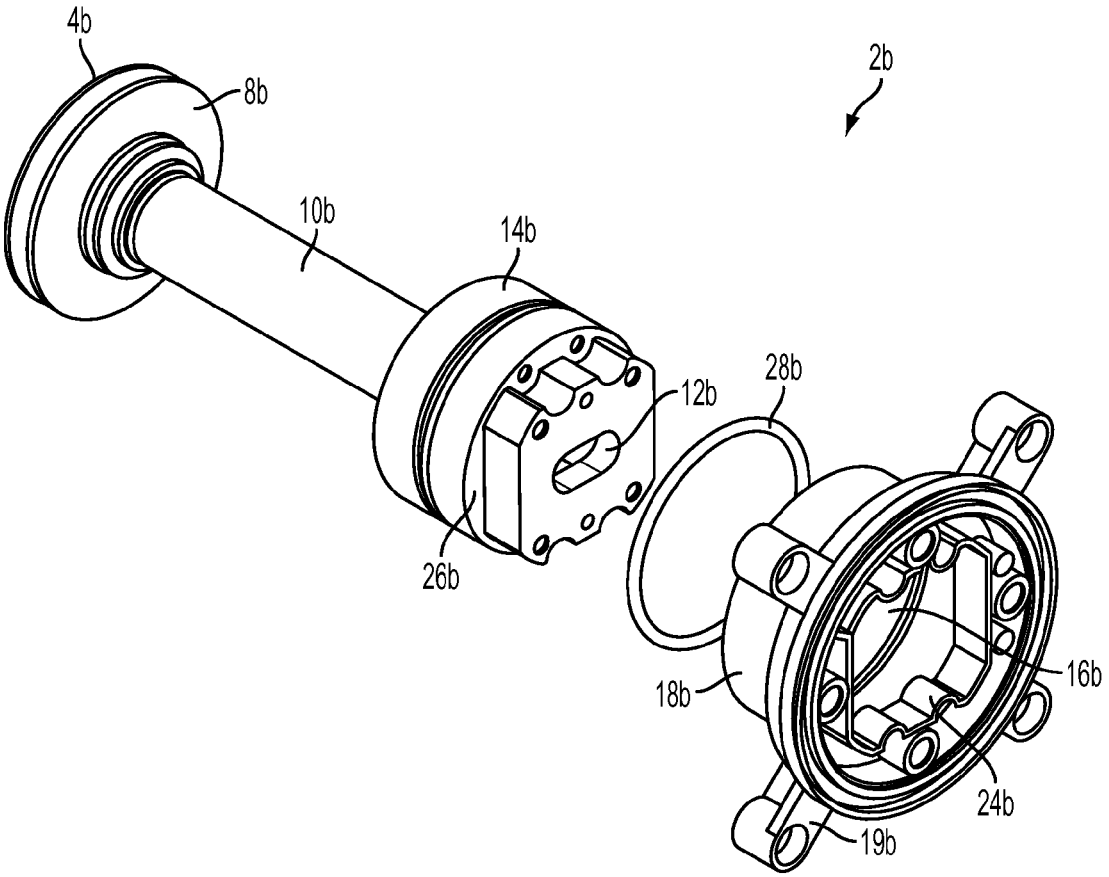
FIG. 11 is a schematic angled isometric distal end exploded view of another alternative modular feed assembly.
Figure 12:
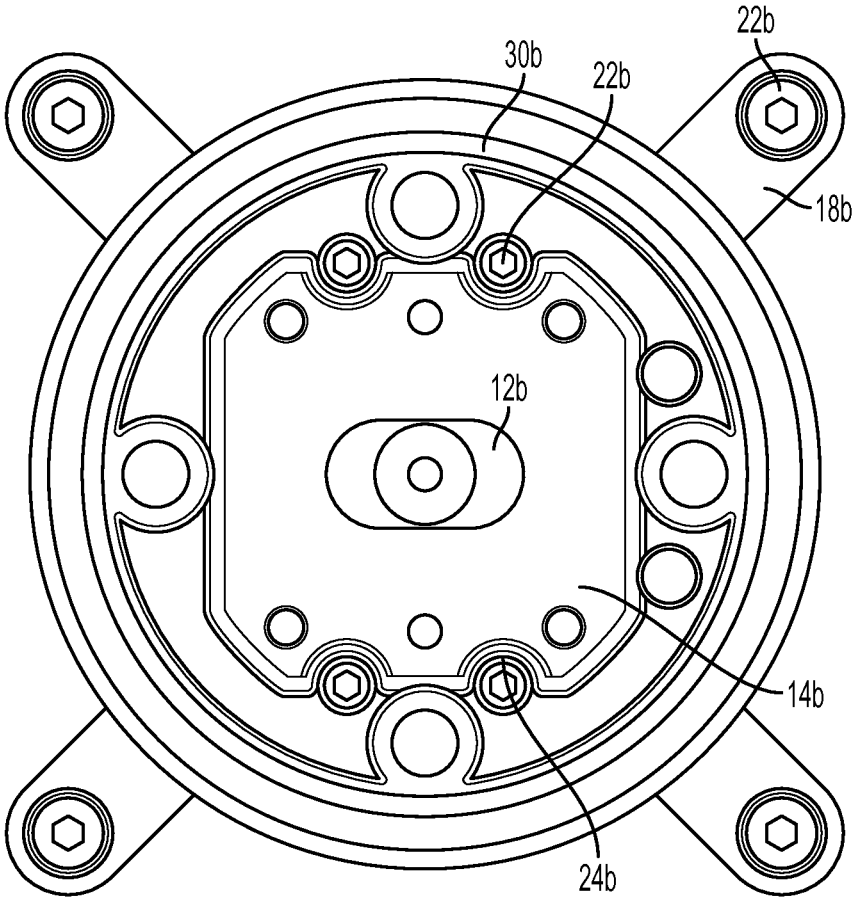
FIG. 12 is a schematic distal end view of the modular feed assembly of FIG. 11.
Figure 13:
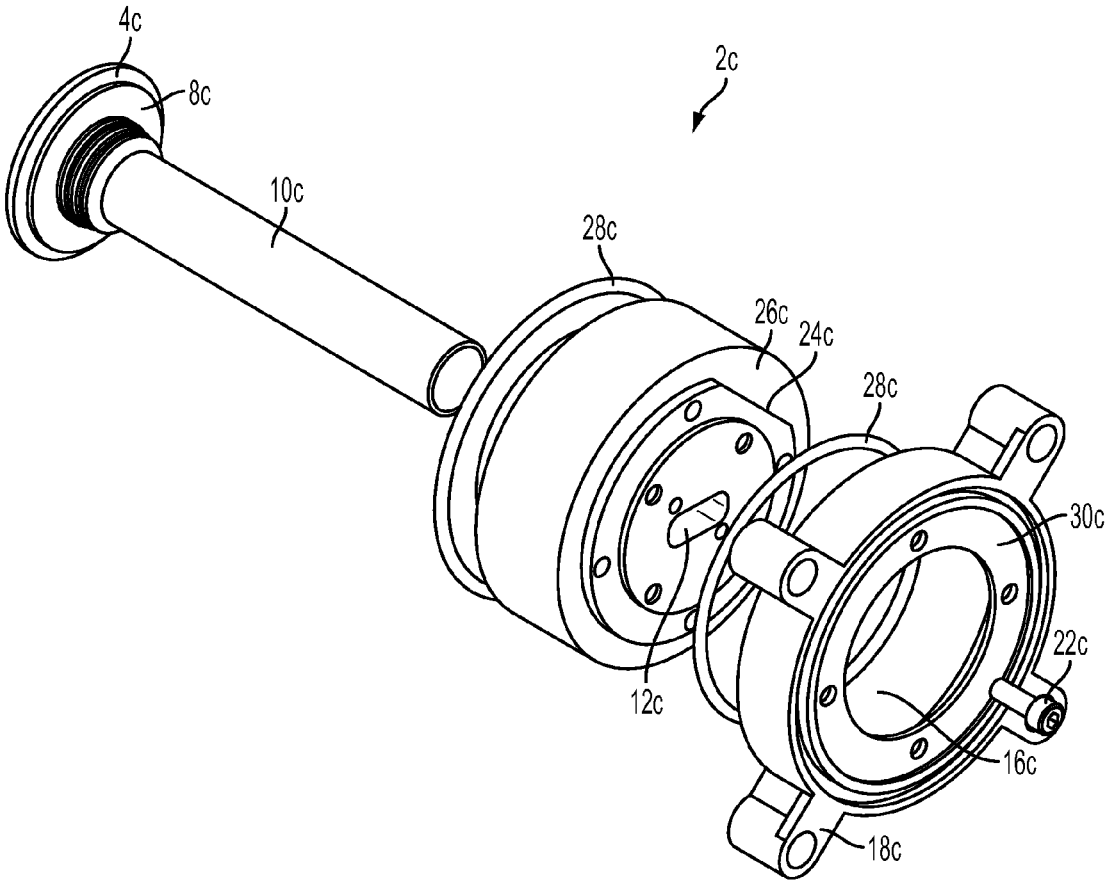
FIG. 13 is a schematic angled isometric distal end exploded view of another alternative modular feed assembly.
Figure 14:
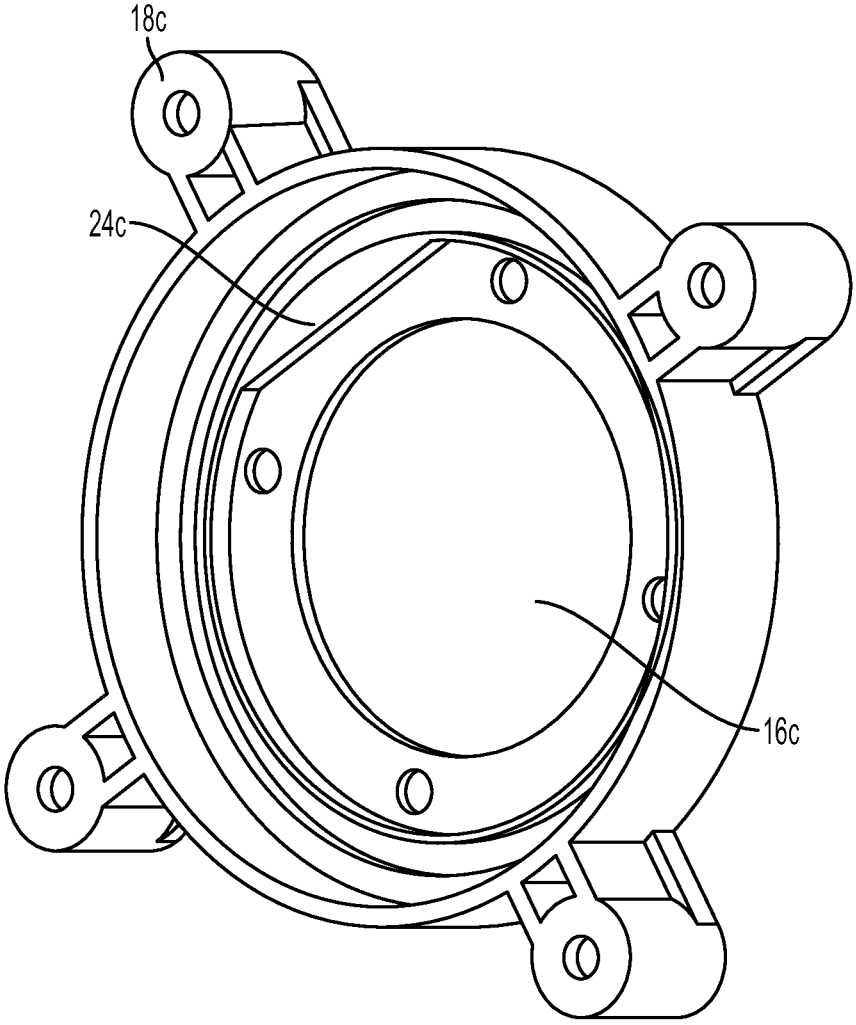
FIG. 14 is a schematic angled proximal end view of the hub adapter of the modular feed assembly of FIG. 13.
Figure 15:
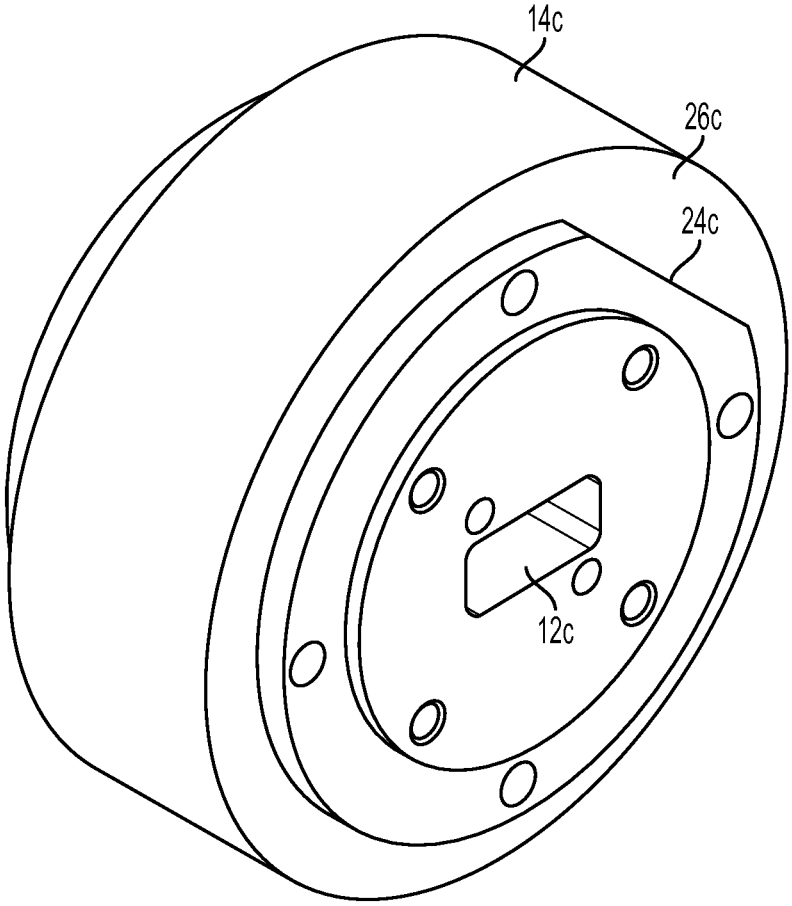
FIG. 15 is a schematic angled distal end view of the transition of the modular feed assembly of FIG. 13.

The engagement between the transition 14 and hub adapter 18 may be environmentally and/or RF sealed by application of one or more seals 28 (FIG. 6) therebetween. An RF-absorbing or -shielding material seal 28 may engage, for example, an outer diameter of the transition 14. An environmental seal 28, such as an elastomer gasket or the like, may be applied, for example, to seal against the proximal end of the transition 14. Additional seals 28 may be provided, for example, at a proximal end face 30 (FIGS. 6 and 7) of the hub adapter 18 to seal between the hub adapter 18 and downstream equipment. The seals 28 may be formed in place upon the hub adapter 18 as a second shot of an injection-molding process applied to form the hub adapter 18, for example, from polymer material. Provided integral with the hub adapter 18, these seals 28 eliminate a potential leakage path around the backside of each seal and reduce the total number of separate parts of the assembly, which may improve the seal effect and reduce potential assembly errors. Alternatively, seals 28*a,b* may be applied, for example, as shown in FIGS. 10 and 11, around an outer diameter of the transition 14*a,b*, for example, seated in a seal groove of the transition 14*a,b* outer diameter.

The transition 14 to hub adapter 18 interconnection may include a snap-fit functionality to retain the transition 14 within the transition bore 16, for ease of initial alignment and/or retention in place, for example, until downstream equipment is coupled to the transition 14, clamping the transition 14 across the hub adapter 18. To prevent excess fastener tightening from damaging the hub adapter 18 and/or to provide an initial amount of axial play for engaging a snap-fit interconnection, the seat shoulder 26 of the transition 14 may seat against an anti-crush ring 32 provided on the hub adapter 18, for example, as shown in FIG. 8.

Retention features for snap-fit interconnection may include a retention groove 34 (FIG. 9) of the transition 14 outer diameter, which receives inward projecting tabs 36 (FIG. 8) of the hub adapter 18. Alternatively, the retention feature may be provided as an inward-biased spring tab 38*a* adapted to engage a retention lip 25*a* of the transition 14*a*, as shown for example in FIG. 10.

One skilled in the art will appreciate that providing the frequency-specific transition 14 enables fabrication of frequency-specific antenna families from a common pool of components, wherein the only unique component between a pair of antennas, each optimized for separate operating frequencies, is the easily exchanged transition 14. Further, the reduction in the size and complexity of the transition 14 may provide a materials and manufacturing efficiency that enables greater use of polymers and injection-molding fabrication, instead of machining, for the remainder of the feed assembly module, which may also enable further advantageous features, such as snap-fit retention arrangements and/or integral seals 28.

Figure 16:
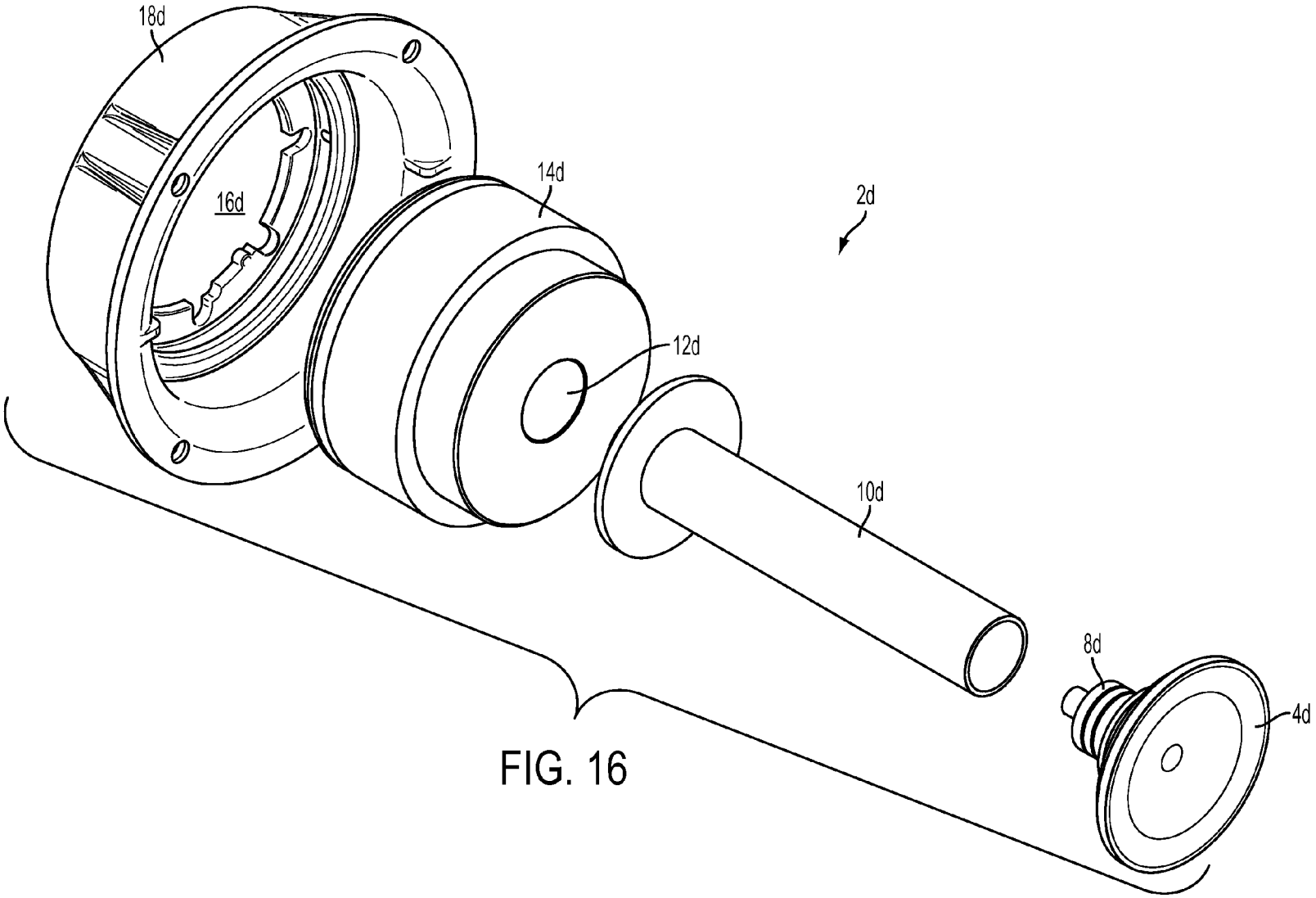
FIGS. 16-27 show different views associated with another alternative modular feed assembly.
Figure 17:
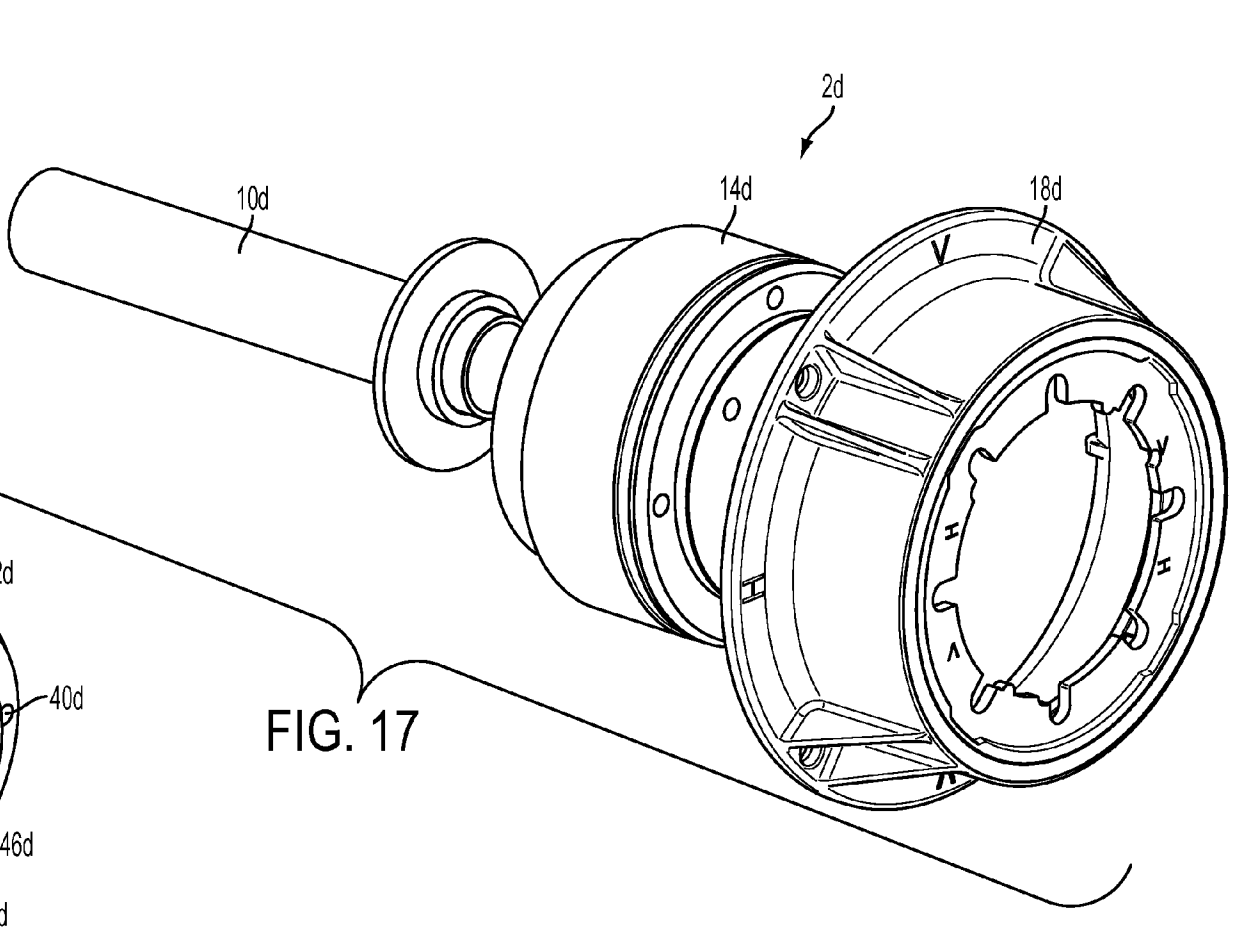

FIGS. 16 and 17 show exploded perspective front and back views, respectively, of an alternative modular feed assembly 2*d* comprising sub-reflector 4*d* connected to dielectric block 8*d*, which mates to cylindrical waveguide 10*d*, which mates to RF bore 12*d* of RF transition 14*d*, and hub adapter 18*d* having transition bore 16*d*, which receives and mates to RF transition 14*d*. When the modular feed assembly 2*d* is assembled, the sub-reflector, dielectric block, and cylindrical waveguide can be inserted through an opening in the hub of an antenna dish, such as hub 20 of FIG. 1, and the hub adapter 18*d* can be mated to the hub to secure the feed assembly 2*d* in place.

Figure 18:
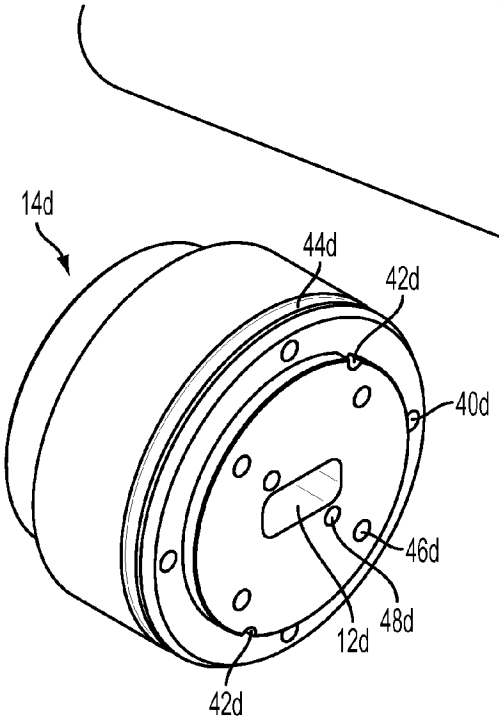

FIG. 18 shows a perspective front view of the RF transition 14*d*. RF bore 12*d* has a circular cross section at the back side of the RF transition (see FIG. 16) and a substantial rectangular cross section at the front side the RF transition (see FIG. 18). As shown in FIG. 18, the front side of RF transition 14*d* has four tapped screw holes 40*d* (90 degrees apart), two timing slots 42*d* (180 degrees apart), and a circumferential groove 44*d*, all of which assist in the mating of the RF transition to hub adapter 18*d* and all of which will be described further below.

FIG. 18 also shows four holes 46*d* separated by 90 degrees and two holes 48*d* separated by 180 degrees on the front side of RF transition 14*d*. Holes 46*d* are used to mount additional components (not shown) typically used in remote radio fitment, and holes 48*d* are tooling jig holes.

Figure 19:
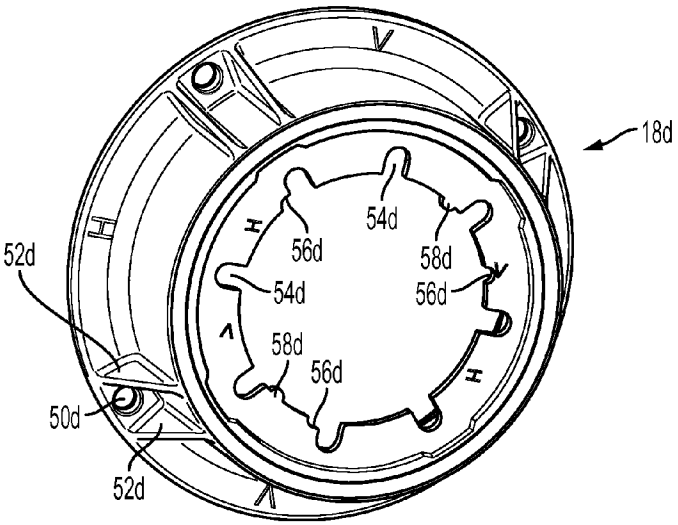
Figure 20:
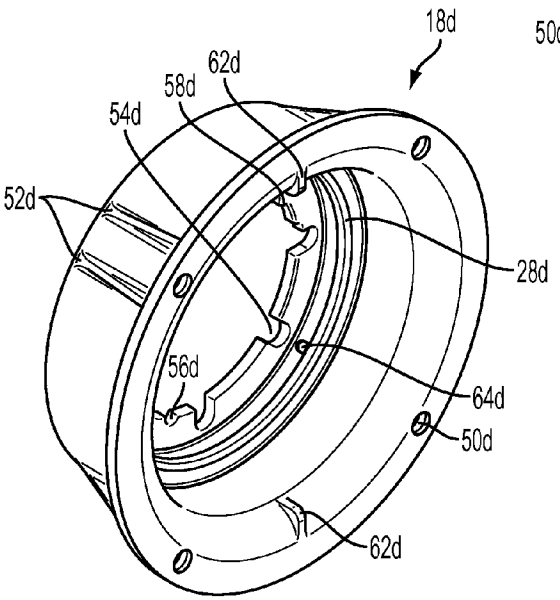
Figure 23:
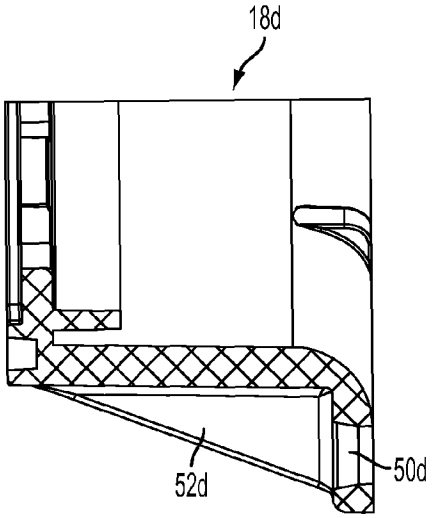
Figure 22:
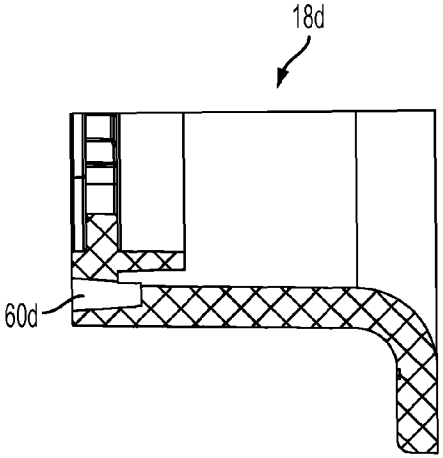
Figure 21:
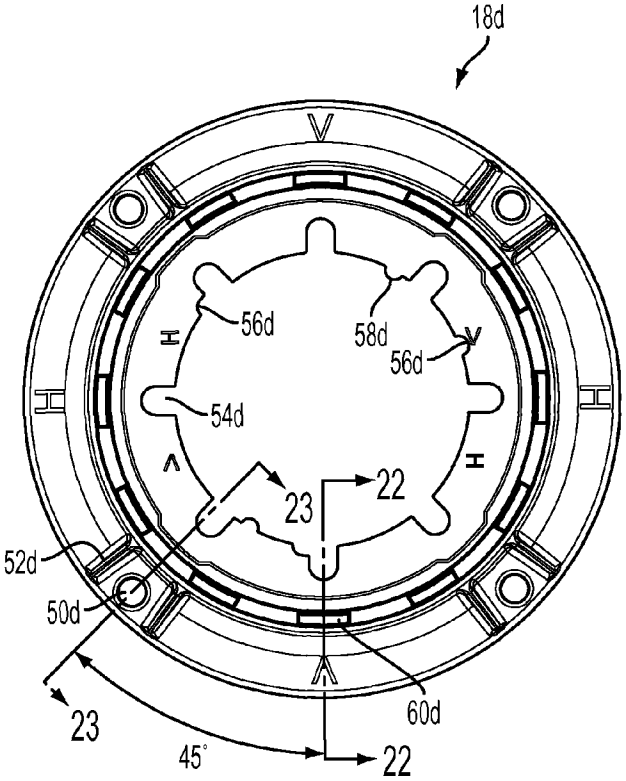

FIGS. 19 and 20 show perspective front and back views, respectively, of hub adapter 18*d*. FIG. 21 shows a plan front view of hub adapter 18*d*, and FIGS. 22 and 23 show two different cross-sectional views of hub adapter 18*d* along cut lines C-C and D-D of FIG. 21, respectively.

Figure 1:
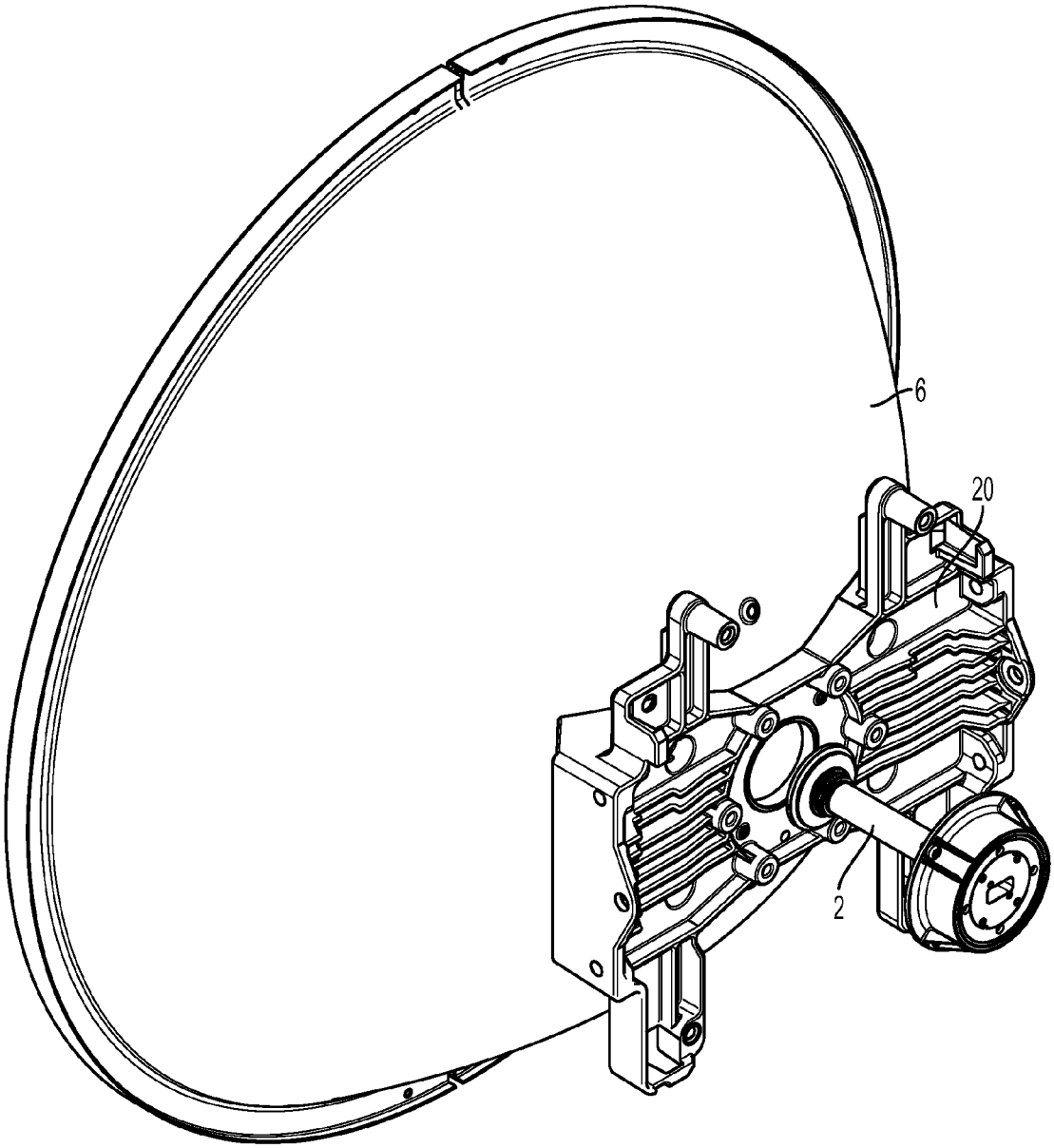
FIG. 1 is a schematic isometric view of a reflector antenna with a modular feed assembly positioned for mating with the hub.
Figure 2:
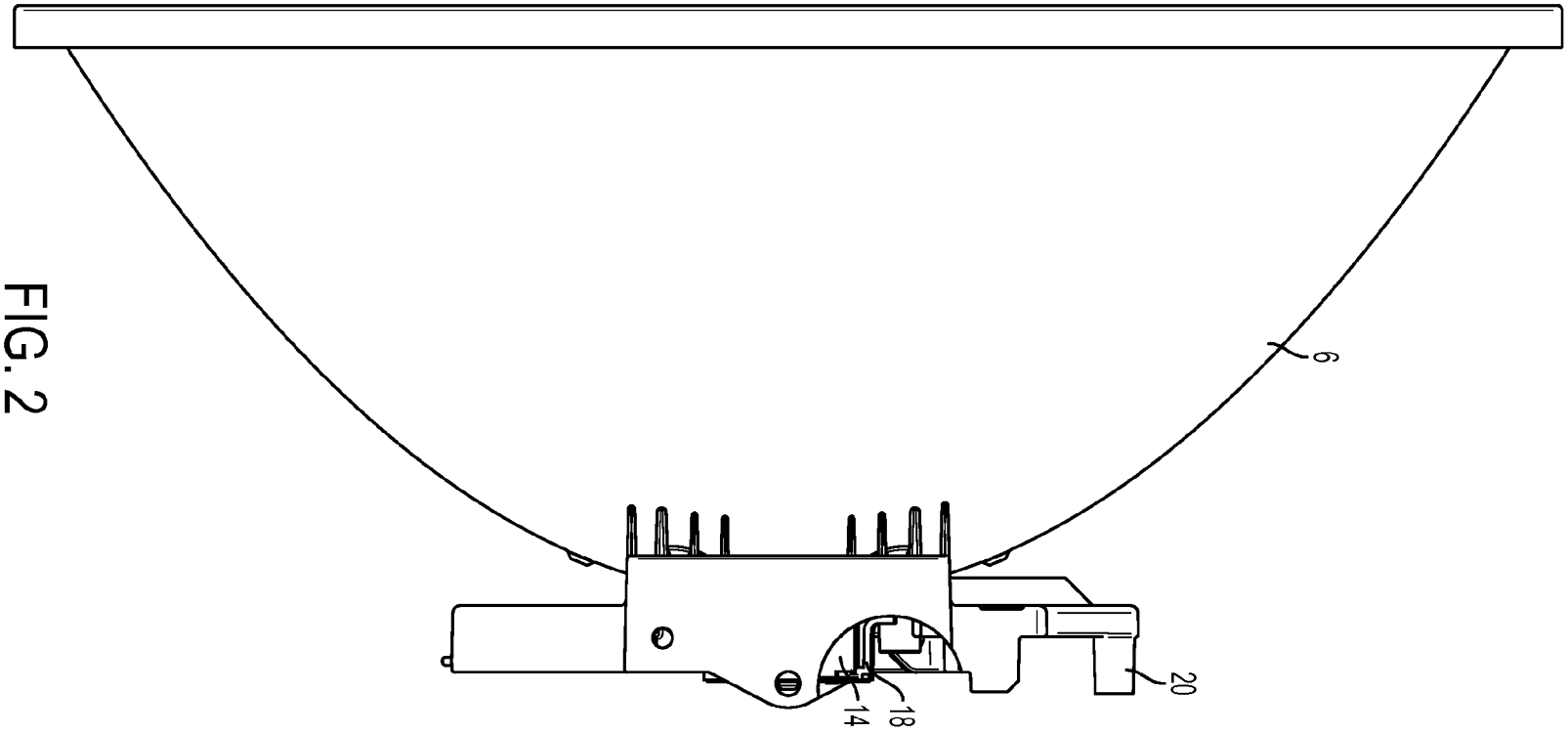
FIG. 2 is a schematic side view of the reflector antenna of FIG. 1, with a partial cut-away to show the seating of the modular feed assembly and the hub.

The back side of hub adapter 18*d* has four untapped screw holes 50*d*, separated by 90 degrees and located between pairs of strengthening ribs 52*d*, for mating the hub adapter (and the entire feed assembly 2) to, for example, hub 20 of FIG. 1.

The front side of hub adapter 18*d* has eight screw slots 54*d* separated by 45 degrees, three injection points 56*d* separated by 120 degrees, and two timing lugs 58*d* separated by 180 degrees. The front side of the hub adapter also has twelve passages 60*d* separated by 30 degrees.

Figure 24:
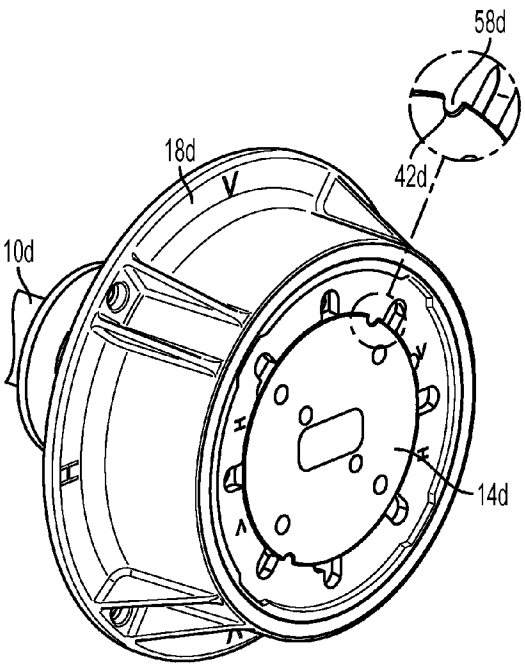
Figure 27:
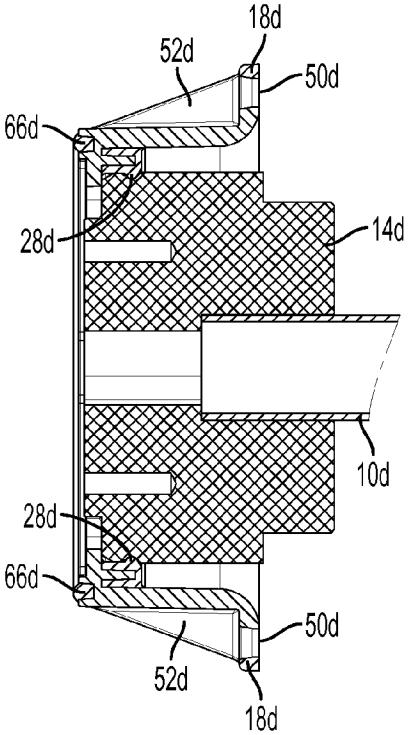
Figure 26:
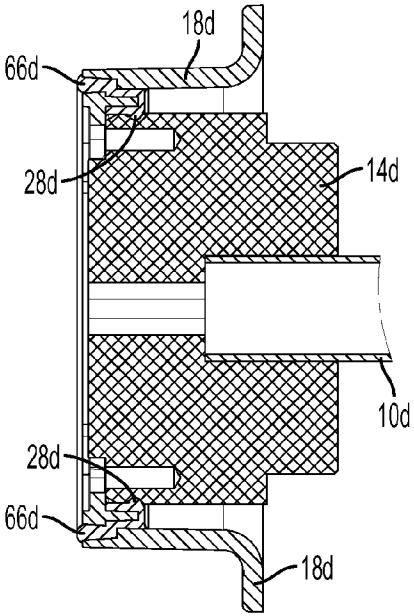
Figure 25:
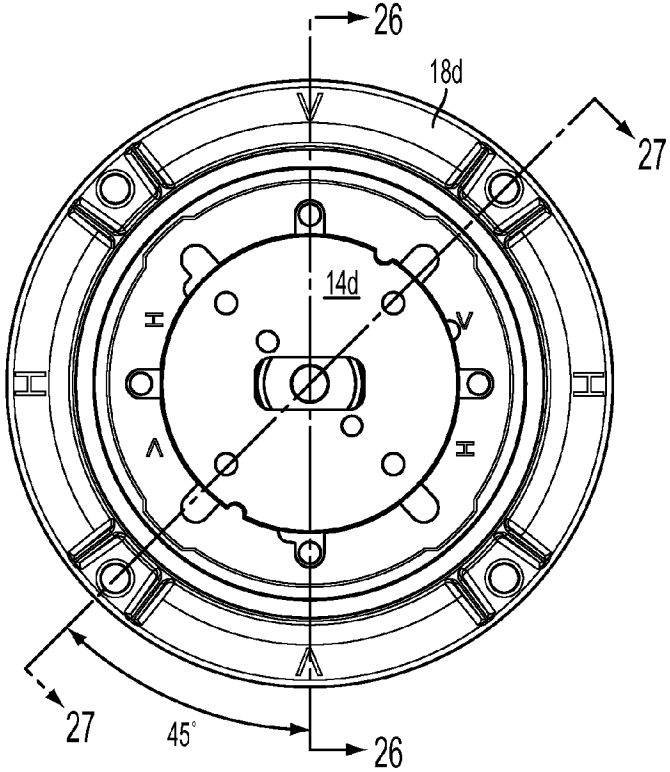

FIGS. 24 and 25 shows perspective and plan front views of the RF transition 14*d* positioned within and mated to the hub adapter 18*d*. FIGS. 26 and 27 show two different cross-sectional views of the RF transition/hub adapter assembly along cut lines A-A and B-B of FIG. 25, respectively.

As shown in the FIGS. 24 and 25, timing lugs 58*d* of RF transition 14*d* mate with timing slots 42*d* of hub adapter 18*d*. Because the two timing lugs 58*d* and two timing slots 42*d* are both separated by 180 degrees, there are only two different orientations in which RF transition 14*d* and hub adapter 18*d* can be configured to one another, and those two orientations are identical. As shown in FIG. 25, when mated together, four of the eight screw slots 54*d* of hub adapter 18*d* line up with the four screw holes 40*d* of RF transition 14*d*, thereby enabling four screws (not shown) to be used to secure the RF transition and hub adapter together. Although the other four screw slots 54*d* of hub adapter 18*d* are not used with RF transition 14*d*, they do enable hub adapter 18*d* to be used with other RF transitions (e.g., for other RF frequencies) having different timing structures that support different orientations between the RF transition and hub adapter 18*d*.

As shown, for example, in FIG. 21, hub adapter 18*d* has the letters H and V, which respectively indicate two different configurations, i.e., horizontal and vertical, respectively, in which the feed assembly 2*d* can be mated to the antenna hub 20 of FIG. 1. In the horizontal configuration, in which the letters H appear at the left and right sides of the hub adapter

18*d* (i.e., 3 and 9 o'clock positions), the longer sides of the rectangular opening 12*d* in the RF transition 14*d* are oriented horizontally (as indicated in FIG. 1). In the vertical configuration, in which the letters V appear at the left and right sides of the hub adapter 18*d*, the longer sides of the rectangular opening 12*d* in the RF transition 14*d* are oriented vertically. Note that, because there are four screw holes 50*d* in hub adapter 18*d* and four corresponding screw holes in hub 20, there are actually two identical horizontal configurations and two identical vertical configurations in which the feed assembly 2*d* can be mated to the hub.

As shown in FIG. 20, hub adapter 18*d* has a relatively resilient (e.g., elastomeric) annular compression element (i.e., gasket) 28*d* that mates with groove 44*d* in RF transition 14*d* to form a watertight seal between the hub adapter and the RF transition to prevent moisture from passing therebetween.

In one implementation, the gasket 28*d* is pre-formed by injecting an uncured elastomer into the injection points 56*d* and passages 60*d* on the front side of hub adapter 18*d*, while the hub adapter is mated to a special injection fixture (not shown) and then curing the elastomer before removing the hub adapter from the injection fixture. The two structures 62*d* separated by 180 degrees are alignment features for mounting the hub adapter to such an injection fixture. Recess 64*d*, shown in FIG. 20, is an injection gate that ensures that excess elastomeric material is sub flush to the gasket 28*d* and does not interfere with its sealing function. The hub adapter 18*d* can then be mated with the RF transition 14*d* by applying force until the gasket 28*d* engages groove 44*d* in the RF transition.

As shown in FIGS. 26 and 27, the injected elastomer forms both the annular gasket 28*d* on the inner cylindrical surface of the hub adapter 18*d* as well as an annular gasket 66*d* on the front face of the hub adapter. This second annular gasket 66*d* helps to form a watertight seal between the hub adapter 18*d* and additional components (not shown) typically used in radio fitment and mated to the feed assembly 2*d*.

Hub adapter 18*d* is made from a relatively rigid material, such as a suitable metal, such as, but not limited to, copper or aluminum, or a suitable plastic such as, but not limited to, polycarbonate, polyester, polybutylene terephthalate (PBT), acrylonitrile butadiene styrene (ABS), or polystyrene. Depending on the material used, hub adapter 18*d* may be made using a suitable technique such as, but not limited to, casting, pressing, or injection molding. RF transition 14*d* is made of a suitable metal.

Where, in the foregoing description, reference has been made to materials, ratios, integers, or components having known equivalents, then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

Unless explicitly stated otherwise, each numerical value and range should be interpreted as being approximate as if the word "about" or "approximately" preceded the value or range.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A modular feed assembly for an antenna comprising:

a hub adapter securable to a hub of the antenna, wherein the modular feed assembly is dimensioned to extend through a reflector dish of the antenna when secured to the hub;

a waveguide transition forming a component distinct from the hub adapter and dimensioned to at least partially seat within a transition bore of the hub adapter, wherein the waveguide transition provides a transition from a first waveguide having a first cross-section to a second waveguide having a second cross-section different from the first cross-section; and wherein the hub adapter and the waveguide transition each comprises structures dimensioned to prevent rotation of the waveguide transition about its longitudinal axis with respect to the hub adapter upon seating of the waveguide transition into the hub adapter.

2. The modular feed assembly of claim 1, wherein:

the first cross-section of the first waveguide is rectangular; and the second cross-section of the second waveguide is circular.

3. The modular feed assembly of claim 1, wherein the structures comprise one or more timing features that limit a rotational orientation between the hub adapter and the waveguide transition to one of a fixed number of possible rotational orientations.

4. The modular feed assembly of claim 3, wherein the one or more timing features limit the possible rotational orientations to two rotational orientations that are separated by a 180-degree rotation.

5. The modular feed assembly of claim 1, wherein the waveguide transition comprises a first waveguide transition, and wherein the hub adapter is dimensioned to receive a second waveguide transition having different frequency characteristics than the first waveguide transition.

6. The modular feed assembly of claim 5, wherein the second waveguide transition and the first waveguide transition have identical mating interfaces for seating within the transition bore of the hub adapter.

7. The modular feed assembly of claim 5, wherein, the first cross-section of the first waveguide of the first waveguide transition is different from a first cross-section of a first waveguide of the second waveguide transition.

8. The modular feed assembly of claim 1, wherein the hub adapter comprises a resilient compression element that forms an annular seal with the waveguide transition that inhibits RF leakage from the antenna.

9. The modular feed assembly of claim 8, wherein the hub adapter comprises one or more passages that allow an elastomeric material to flow through the hub adapter to form the resilient compression element.

10. The modular feed assembly of claim 9, wherein the one or more passages allow the elastomeric material to flow through the hub adapter to form the resilient compression element after the waveguide transition is seated in the transition bore of the hub adapter.

11. An assembly comprising the modular feed assembly of claim 1, wherein the modular feed assembly is secured to the hub.

12. The assembly of claim 11, wherein the hub is secured to the reflector dish of the antenna.

13. A method for forming a modular feed assembly for an antenna, the method comprising:

(a) providing a hub adapter that is securable to a hub of the antenna, wherein the modular feed assembly is dimensioned to extend through a reflector dish of the antenna when the hub adapter is secured to the hub; and (b) at least partially seating a waveguide transition within a transition bore of the hub adapter, wherein the waveguide transition forms a component distinct from the hub adapter;

wherein the waveguide transition provides a transition from a first waveguide having a first cross-section to a second waveguide having a second cross-section different from the first cross-section; and wherein the hub adapter and the waveguide transition comprise structures that prevent rotation of the waveguide transition about its longitudinal axis with respect to the hub adapter after the waveguide transition is at least partially seated within the transition bore of the hub adapter.

14. The method of claim 13, wherein:

the structures comprise one or more timing features that limit a rotational orientation between the hub adapter and the waveguide transition to one of a fixed number of possible rotational orientations; and wherein at least partially seating the waveguide transition within the transition bore of the hub adapter comprises seating the waveguide transition within the transition bore of the hub adapter in a selected one of the possible rotational orientations.

15. The method of claim 13, wherein the waveguide transition comprises a first waveguide transition, the method further comprising:

(c) unseating the first waveguide transition from the transition bore of the hub adapter; and (d) at least partially seating a second waveguide transition into the transition bore of the hub adapter, wherein the second waveguide transition comprises different frequency characteristics than the first waveguide transition.

16. The method of claim 13, wherein the hub adapter comprises a resilient compression element that forms an annular seal with the waveguide transition that inhibits RF leakage from the antenna.

17. The method of claim 16, wherein:

the hub adapter comprises one or more passages; and the method further comprises flowing an elastomeric material through the passages in the hub adapter to form the resilient compression element.

18. The method of claim 17, wherein the flowing the elastomeric material through the passages in the hub adapter to form the resilient compression element is performed after at least partially seating the waveguide transition within the transition bore of the hub adapter.

* * * * *